US008535505B2

(12) United States Patent
Yi et al.

(10) Patent No.: US 8,535,505 B2
(45) Date of Patent: Sep. 17, 2013

(54) METHOD FOR MAKING METALLIC COVER

(75) Inventors: Hong-Zhan Yi, Shenzhen (CN); Ai-Jun Xu, Shenzhen (CN); Lone-Wen Tai, New Taipei (TW); Zi-Li Wu, Shenzhen (CN); Jun Dai, Shenzhen (CN); Xiao-Bo Yuan, Shenzhen (CN)

(73) Assignees: Hong Fu Jin Precision Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/541,039

(22) Filed: Jul. 3, 2012

(65) Prior Publication Data

US 2012/0267250 A1 Oct. 25, 2012

Related U.S. Application Data

(62) Division of application No. 11/954,228, filed on Dec. 12, 2007, now Pat. No. 8,277,008.

(30) Foreign Application Priority Data

Jun. 14, 2007 (CN) ..... 2007 1 0200819

(51) Int. Cl.
*C25D 11/04* (2006.01)
*B32B 15/04* (2006.01)

(52) U.S. Cl.
USPC ..... 205/324; 428/603

(58) Field of Classification Search
USPC ..... 205/324–332
See application file for complete search history.

(56) References Cited

U.S. PATENT DOCUMENTS 6,771,490 B2 * 8/2004 Peker et al. ..... 361/679.34
2005/0087454 A1 * 4/2005 Chen ..... 206/39

* cited by examiner

*Primary Examiner* — Nicholas A Smith
*Assistant Examiner* — Brian W Cohen
(74) *Attorney, Agent, or Firm* — Altis Law Group, Inc.

(57) ABSTRACT

A method for making a metallic cover including the following steps. Drawing an aluminum alloy sheet that has a yield strength in a range from about 80 MPa to about 150 MPa, an elongation ratio in a range from about 15% to about 28%, and a hardness in a range from about 45 HV0.2 to about 70 HV0.2 to form a preformed cover. The preformed cover includes a bottom base and a plurality of side walls, and each of the side wall and the bottom base are connected by a curved-cornered edge. Pressing the curved-cornered edge of the preformed cover into a sharp-cornered edge structure by a forming die. Polishing the preformed cover. Anodizing the polished preformed cover to form the metallic cover.

6 Claims, 7 Drawing Sheets

METHOD FOR MAKING METALLIC COVER

CROSS-REFERENCE TO RELATED APPLICATION

The present application is a divisional application of U.S. patent application Ser. No. 11/954,228, filed on Dec. 12, 2007, now U.S. Pat. No. 8,277,008, which claims all benefits accruing under 35 U.S.C. §119 from CN 200710200819.2, filed on Jun. 14, 2007, the contents of which are hereby incorporated by reference.

BACKGROUND

1. Field of the Invention

The present disclosure generally relates to a method for making a metallic cover used for electronic device.

2. Description of the Related Art

Generally, a metallic cover has a more appealing appearance and a better surface feeling than a plastic cover, thus metallic covers are popularly used for electronic devices such as flat-panel display devices.

Referring to FIG. 7, a typical metallic cover 10 is shown. The metallic cover 10 includes a rectangular bottom base 11, a first side wall 12, a second side wall 13, a third side wall 14, and a fourth side wall 15. The side walls 12, 13, 14, 15 perpendicularly extend from a periphery of the rectangular bottom base 11. Each of the side walls 12, 13, 14, 15 and the bottom base 11 are connected by an edge structure 16. The edge structure 16 is generally designed to be a curve-cornered edge so that the metallic cover 10 is easy to be made by metal drawing method. Each of the side walls 12, 13, 14, 15 connects to its adjacent side walls, thus the side walls 12, 13, 14, 15 cooperatively define a cavity (not labeled) for receiving electronic components (not shown).

In order to obtain a different appearance, an edge structure of another typical cover for connecting the side walls and the bottom base may be a sharp-cornered edge instead of the curve-cornered edge. Generally, the sharp-cornered edge is impossible to be made by metal drawing method. A typical method for making a metallic cover with a sharp-cornered edge is made by the two following steps: drawing a metal sheet into a preformed cover; pressing the preformed cover into a metallic cover with a sharp-cornered edge by a forming die. However, the above described method is prone to cause cracks in the edge structure of the metallic cover, thus decreasing quality of the metallic covers.

In addition, the metallic covers made by the above described method need to be processed by an anodizing process. After the anodizing process, color of surface of the edge structure of the metallic cover is quite different from that of other parts of the metallic cover, thereby decreasing the quality of the appearance of the cover.

Therefore, a new metallic cover is desired in order to overcome the above described shortcomings. A method for making the metallic cover is also needed.

BRIEF DESCRIPTION OF THE DRAWINGS

The components in the drawings are not necessarily drawn to scale, the emphasis instead being placed upon clearly illustrating principles of the present metallic cover and method for making the same. Moreover, in the drawings, like reference numerals designate corresponding parts throughout several views, and all the views are schematic.

DETAILED DESCRIPTION OF THE EMBODIMENTS

Reference will now be made to the drawings to describe preferred embodiments of the present metallic cover and method in detail.

Figure 1:
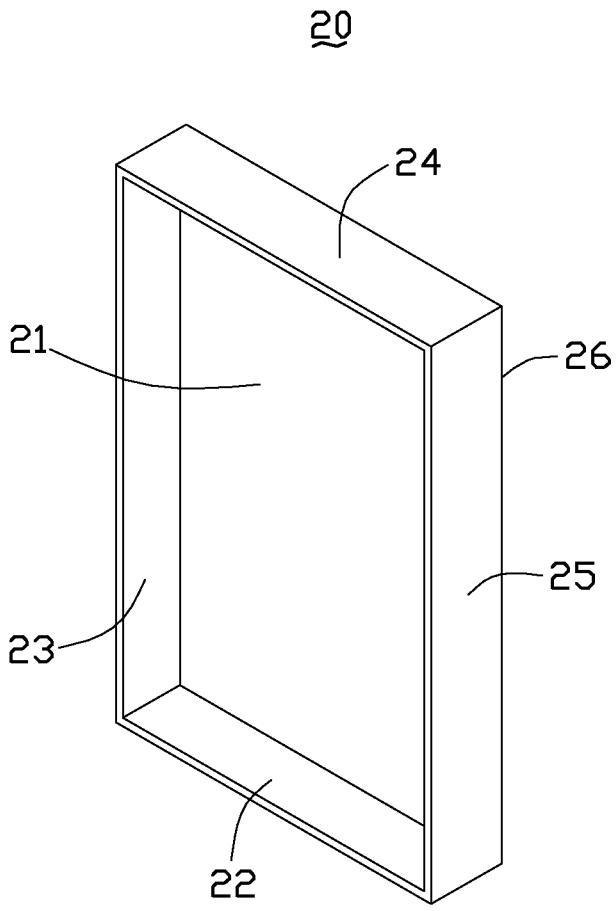
FIG. 1 is an isometric view of a metallic cover in accordance with one embodiment of the present disclosure.
Figure 6:
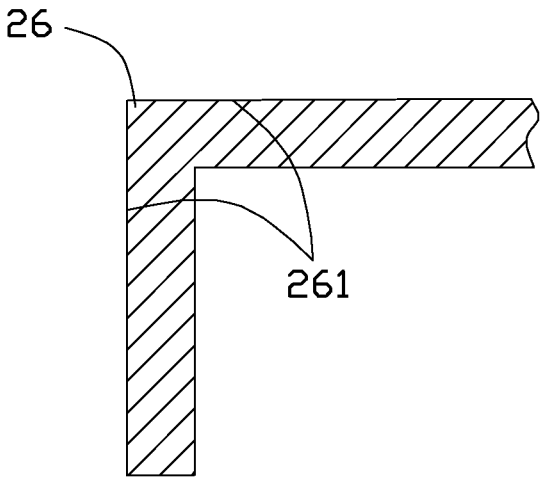
FIG. 6 is partial, cross-sectional view of an edge structure of the preformed metallic cover pressed by the forming die of FIG. 4.
Figure 7:
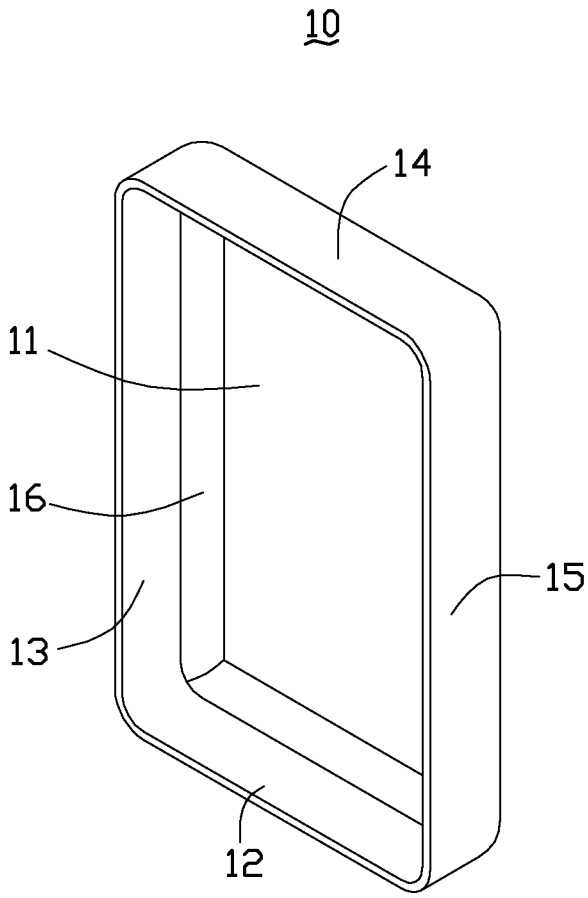
FIG. 7 (RELATED ART)
FIG. 7 is an isometric view of a conventional metallic cover.

Referring to FIG. 1, a metallic cover 20 according to one embodiment is shown. In the illustrated embodiment, the metallic cover 20 is used as a cover for a flat-panel display device. The metallic cover 20 includes a rectangular bottom base 21, a first side wall 22, a second side wall 23, a third side wall 24, and a fourth side wall 25. The side walls 22, 23, 24, 25 perpendicularly extend from a periphery of the rectangular bottom base 21. The side walls 22, 23, 24, 25 cooperatively define a cavity (not labeled). The bottom base 21 and each of the side walls 22, 23, 24, 25 are correspondingly connected by an edge structure 26. The edge structure 26 is a sharp-cornered edge. The angle formed between an outer surface 261 (see FIG. 6) of the bottom base 21 and the outer surface 261 of each of the sidewalls 22, 23, 24, 25 at the edge structure 26 is in the range from 90 degrees to 135 degrees.

Empirical data shows that the cause of the cracks and the discolorations in the conventional metallic cover is due to the material of the conventional metallic cover. The conventional metallic cover is made of a material that has a relatively large yield strength (about 197 megapascals (Mpa)) and a relatively low elongation ratio (about 12%). The material at and around the edge structure of the metallic cover deforms badly, thereby causing cracks and discolorations on the conventional cover. In order to avoid or decrease cracks and discolorations in the metallic cover 20, the metallic cover 20 should be made of a material that has a relatively low yield strength and a relatively large elongation ratio. In a preferred embodiment, the metallic cover 20 is made of a metallic material that has a yield strength in the range from 80 MPa to 150 MPa, an elongation ratio in the range from 15% to 28%, and a hardness in the range from 45 Vickers Hardness 0.2, (HV0.2) to 70 HV0.2. The metallic material is preferred to be aluminum alloys such as 5052-O aluminum alloy and 6061-T4 aluminum alloy. A zinc concentration in the above described aluminum alloys is less than 0.1%.

A yield strength of the 5052-O aluminum alloy is about 110 MPa, an elongation ratio of the 5052-O aluminum alloy is about 26%, a hardness of the 5052-O aluminum alloy is about 65 HV0.2, and a zinc concentration is about 0.07%. A yield strength of the 6061-T4 aluminum alloy is about 90 MPa, an elongation ratio of the 6061-T4 aluminum alloy is about 26%, a hardness of the 6061-T4 aluminum alloy is about 60 HV0.2, and a zinc concentration is about 0.06%.

Aluminum alloys used in making the metallic cover 20 have a relatively low yield strength and a relatively large elongation ratio, thus the aluminum alloys generally have good malleability, good corrosion resistance, and easy to anodize. The material of the edge structure of the metallic cover allows edge structures to be easily formed and limits deformation, thus, effectively reducing cracks in the edge structure 26. In addition, the material of the edge structure 26 is deformed slightly, and has a good corrosion resistance, thus effectively reducing discolorations of the metallic cover 20 that is processed by an anodizing process. Therefore, the metallic cover 20 has a good appearance.

Figure 2:
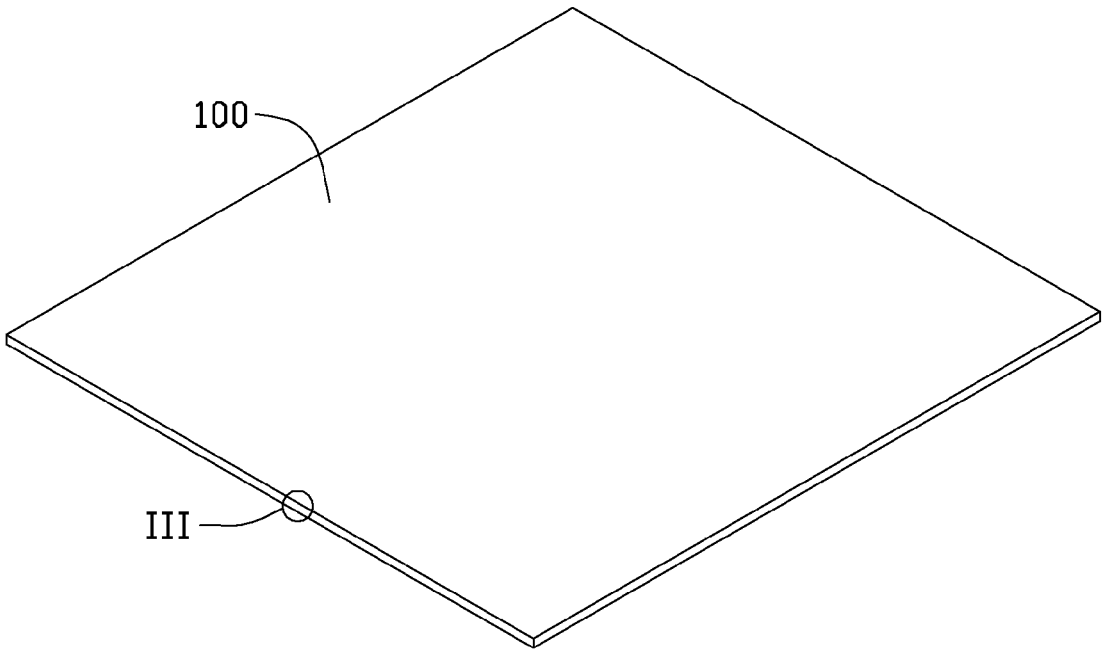
FIG. 2 is an isometric of an aluminum alloy sheet used for making the metallic cover shown in FIG. 1.
Figure 3:
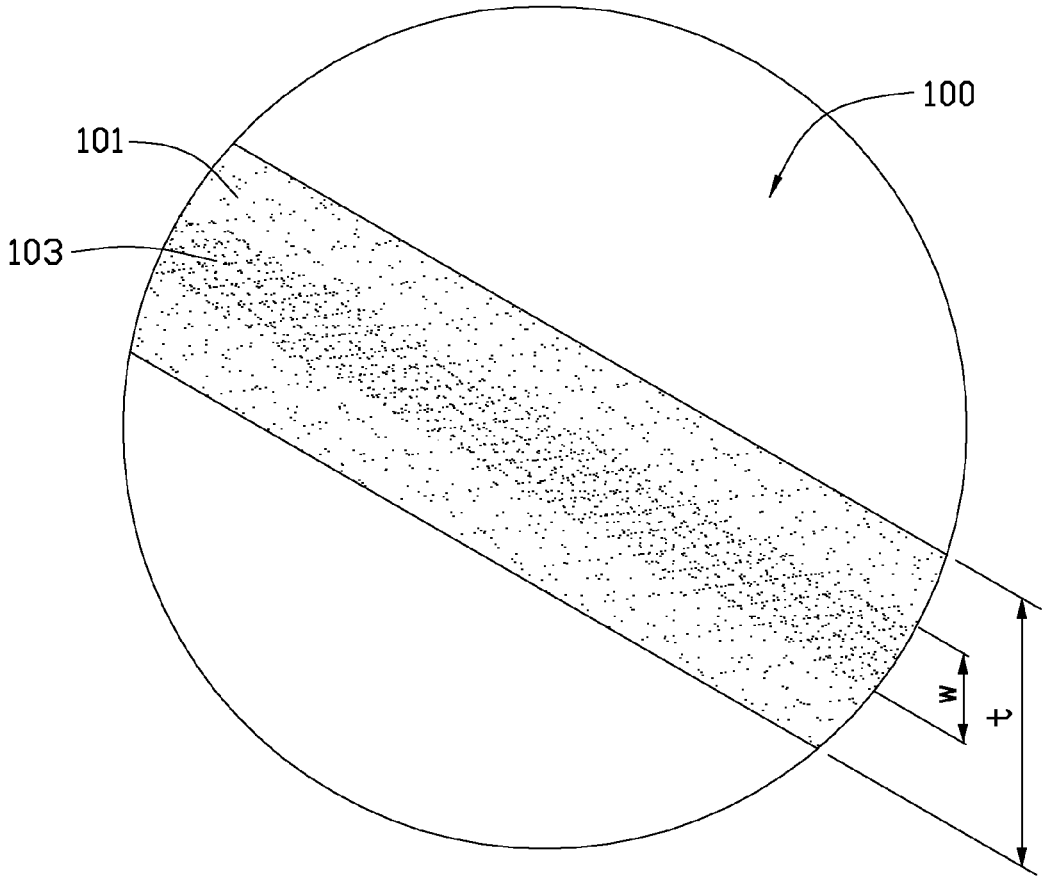
FIG. 3 is an enlarged view of an encircled portion III shown in FIG. 2.

Referring to FIGS. 2 and 3, a cross-sectional view of an aluminum alloy sheet 100 used for making the metallic cover 20 is shown, and t the cross-sectional view is taken along a direction for measuring a thickness of the aluminum alloy sheet 100. Viewed from the thickness direction, an inner structure the aluminum alloy sheet includes two regular portions 101 and a sensitive portion 103 sandwiched between the two regular portions 101. The color of the sensitive portion 103 is darker than that of the regular portion 101. In order to further increase the quality of the surface of the edge structure 26, a width-thickness ratio of the sensitive portion 103 is preferably to be $0<W/t<0.33$, wherein W represents a width of the sensitive portion 103, and t represents a thickness of the aluminum alloy sheet. For example, the aluminum alloy sheet is made of 5052-O aluminum alloy, and $W/t=0.23$.

Figure 4:
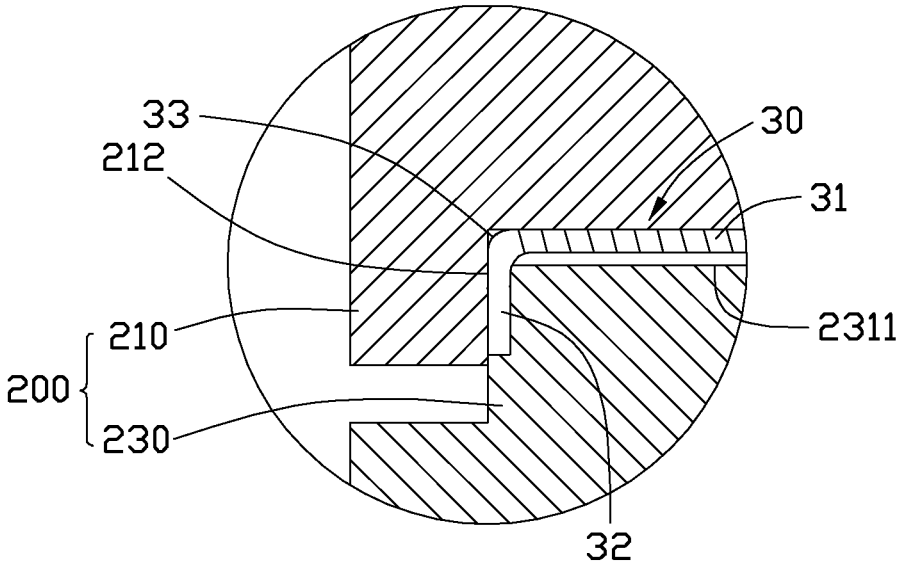
FIG. 4 is a cross-sectional view of a forming die used for pressing a preformed metallic cover to form the present metallic cover.
Figure 5:
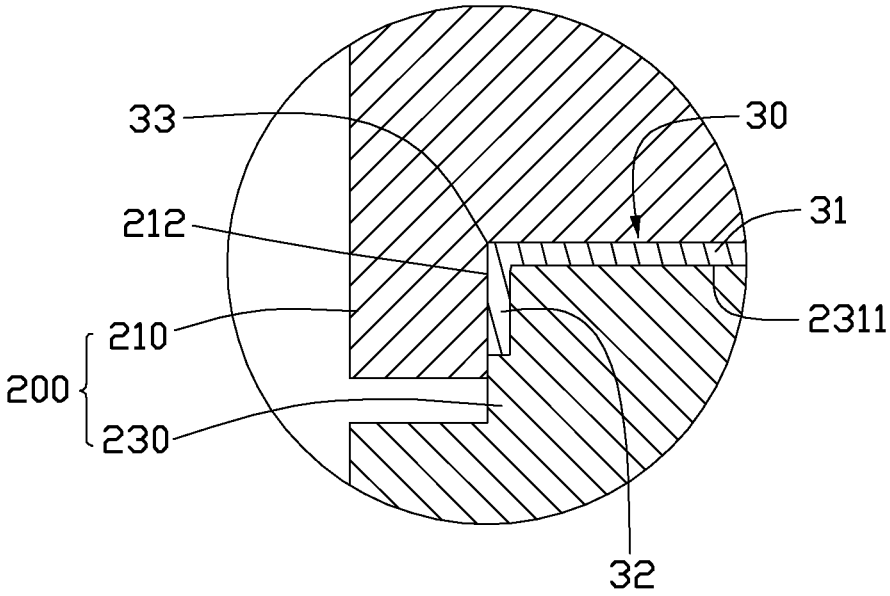
FIG. 5 is similar to FIG. 4, but showing another state.

Referring to FIGS. 4 and 5, an exemplary method for making the metallic cover 20 will now be described. In the illustrated embodiment, the metallic cover 20 is made of the aluminum alloy sheet 100. The method for making the metallic cover includes the following steps: a drawing process; a pressing process; a polishing process; and an anodizing process.

In the drawing process, the aluminum alloy sheet 100 that has a yield strength in the range from 80 MPa to 150 Mpa, an elongation ratio in the range from 15% to 28%, and a hardness in the range from 45 HV0.2 to 70 HV0.2 is drawn to form a preformed cover 30. The aluminum alloy sheet is preferred to be made of 5052-O aluminum alloy or 6061-T4 aluminum alloy. The preformed cover 30 includes a bottom base 31 and a plurality of side walls 32. The side walls 32 cooperatively define a cavity (not shown) for receiving electronic components (not shown). After drawn, the bottom base 31 and each of the sidewalls 32 is connected by a curved-cornered edge 33.

In the pressing process, the curved-cornered edge 33 of the preformed cover 30 is pressed into a sharp-cornered edge structure 26 (see FIG. 6) by a forming die 200. The forming die 200 includes an upper die 210 and a lower die 230. The upper die 210 is movable relative to the lower die 230. The upper die 210 defines mold groove 212 and the mold groove 212 faces a forming surface 2311 of the lower die 230. In use, the preformed cover 30 is mounted on the forming surface 2311 of the lower die 230, and the mold groove 212 of the upper mold 210 and the forming surface 2311 of the lower die 230 cooperatively press the curved-cornered edge 33 of the preformed cover 30 into the sharp-cornered edge structure 26 (see FIG. 6).

After the pressing process, the preformed cover 30 is polished.

After the polishing process, the preformed cover 30 is anodized, and then the preformed cover 30 is made into the metallic cover 20.

In alternative embodiments, after the pressing process, the preformed cover 30 is milled by a milling process so that the preformed cover 30 can have a relative better appearance.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A method for making a metallic cover, comprising:

forming a preformed cover by drawing an aluminum alloy sheet, the aluminum sheet having a yield strength in a range from about 80 MPa to about 150 MPa, an elongation ratio in a range from about 15% to about 28%, and a hardness in a range from about 45 HV0.2 to about 70 HV0.2, the preformed cover having a bottom base and a plurality of side walls, and each of the side walls and the bottom base being connected by a curved-cornered edge;

pressing the curved-cornered edge of the preformed cover into a sharp-cornered edge by a forming die;

polishing the preformed cover; and anodizing the polished preformed cover to form the metallic cover wherein the aluminum alloy sheet has an inner structure including two regular portions and a sensitive portion sandwiched between the two regular portions, a width-thickness ratio of the sensitive portion is preferably to be $0<W/t<0.33$, wherein W represents a width of the sensitive portion, and t represents a thickness of the aluminum alloy sheet.

2. The method of claim 1, wherein the aluminum alloy sheet is made of 5052-O aluminum alloy.

3. The method of claim 1, wherein the aluminum alloy sheet is made of 6061-T4 aluminum alloy.

4. The method of claim 1, wherein the angle formed between an outer surface of the bottom base and the outer surface of each of the sidewalls at the sharp-cornered edge is in the range from 90 degrees to 135 degrees.

5. The method of claim 1, wherein the forming die includes an upper die and a lower die, the upper die is movable relative to the lower die, the upper die defines a mold groove facing a forming surface of the lower die, and the mold groove of the upper die and the forming surface of the lower die cooperatively press the curved-cornered edge of the preformed cover into the sharp-cornered edge.

6. The method of claim 1, wherein the aluminum alloy sheet is made of 5052-O aluminum alloy, and W/t is 0.23.

* * * * *